United States Patent [19]

Kulka et al.

[11] 3,975,309

[45] Aug. 17, 1976

[54] 2,4-DIHYDROXY-3-METHYL-BENZALDEHYDE PERFUME COMPOSITIONS

[75] Inventors: Kurt Kulka, New York; Teodosij Zazula, Rego Park, both of N.Y.

[73] Assignee: Fritzsche Dodge & Olcott Inc., New York, N.Y.

[22] Filed: June 26, 1975

[21] Appl. No.: 590,415

[52] U.S. Cl. ..... 252/522; 260/600 R

[51] Int. Cl.[2] ..... C11B 9/00

[58] Field of Search ..... 252/522; 260/598, 599, 260/600

[56] References Cited

UNITED STATES PATENTS

| | | | |
|---|---|---|---|
| 3,658,875 | 4/1972 | Brunie et al. | 260/600 |
| 3,799,940 | 3/1974 | Mains | 260/600 |
| 3,884,843 | 5/1975 | Kulka | 252/522 |
| 3,901,830 | 8/1975 | Kulka | 252/522 |

FOREIGN PATENTS OR APPLICATIONS

| | | | |
|---|---|---|---|
| 987,947 | 3/1965 | United Kingdom | 260/600 |

OTHER PUBLICATIONS

Elfred Thomas Jones et al., Chem. Soc. J. H., Jan.–June, Proceedings 1932, pp. 1689–1693.

*Primary Examiner*—Veronica O'Keefe
*Attorney, Agent, or Firm*—Frank M. Nolan

[57] ABSTRACT

The effect of the characteristic odor note of Oak Moss in the combination of components in perfume compositions can be achieved by substituting 2,4-dihydroxy-3-methyl-benzaldehyde, produced in a one step synthesis from readily available material, for Oak Moss which is available only in limited quantities at high cost.

4 Claims, No Drawings

2,4-DIHYDROXY-3-METHYL-BENZALDEHYDE PERFUME COMPOSITIONS

This invention relates to 2,4-dihydroxy-3-methyl-benzaldehyde perfume compositions. In the art of perfumery, the extracts of lichens such as those marketed under the name of "Oak Moss" have become indispensable and are widely used as materials for perfumes. The natural extracts of Oak Moss, however, have limited availability and are very expensive. Applicants have discovered that when 2,4-dihydroxy-3-methyl-benzaldehyde is combined with other perfume components, it serves as a substitute for "Oak Moss" in the combination of components which determine the odor note of various perfume compositions. In addition, this chemical not only simulates with great fidelity the characteristic odor note of Oak Moss, it is much less expensive than natural oak Moss or its synthetic simulations, and can be prepared from readily available materials in a one step synthesis. The discovery of the unexpected odor note imparted by this chemical when combined with other perfume components becomes even more significant since its value in perfumery could not be predicted from the knowledge of a closely related chemical such as 2,6-dihydroxy4-methyl-benzaldehyde (ATRENOL) which, for all practical purposes, is odorless and therefore valueless in perfumery.

In accordance with this invention, at least 1% by weight of 2,4-dihydroxy-3-methyl-benzaldehyde is mixed with at least 1% by weight of one or more other perfume components. Desirably, the amount of 2,4-dihydroxy-3-methyl-benzaldehyde is 0.1 to 15% by weight; preferably 0.5 to 10% by weight; and most advantageously 1 to 9% by weight of the perfume composition.

The other perfume component or components comprise in their entirety at least 1% by weight and preferably at least 10% by weight of the total perfume composition.

The 2,4-dihydroxy-3-methyl-benzaldehyde perfume compositions of this invention may be used in soaps, creams, sachets and other cosmetic or household products.

The 2,4-dihydroxy-3-methyl-benzaldehyde having the following chemical structure:

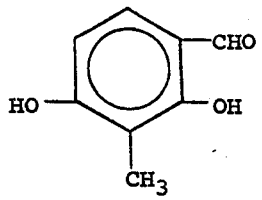

was prepared by Elfeed Thomas Jones and Alexander Robertson [Journal of the Chemical Society, London, page 1691 (1932)] by the condensation of 2,6-dihydroxytoluene with zinc cyanide and excess hydrogen chloride. It may be produced by placing 496 g of 2-methyl-resorcinol, 712 g of n-methyl-formanilide and 300 ml of benzene in a 3-necked five liter flask fitted with an agitator, reflux condenser, dropping funnel and thermometer. After a homogeneous solution is obtained by agitation at room temperature, 808 g of phosphorus oxychloride are added over a period of 2 hours, maintaining the reaction temperature at 25°–30°C.

After the addition is completed, agitation is continued for about 4 hours at 25°–30°C with occasional cooling. During the reaction, 600 ml of benzene are added to the reaction mixture.

The reaction mixture is cooled in an isopropanol-dry ice bath. 100 ml of ice water are added in one portion to the reaction mixture, followed by the addition with agitation of 2000 ml of a 50% aqueous sodium acetate solution over a period of 50 minutes (exothermic) allowing the reaction temperature to rise to a maximum of 65°C. The reaction mixture is cooled to 20°C and 1000 ml of a 50% aqueous acetate solution (precooled to 25°C) are added under agitation in one portion. 800 ml of ethyl acetate (solvent) are added. The mixture is agitated for about 5 minutes and permitted to separate into an aqueous part and an organic layer, which is washed with 200 ml of water. The solvent (ethyl acetate) is removed by distillation under vacuum from a steam bath. The crude reaction product is cooled to 20°C and the formed crystals are filtered on a Buchner funnel. The crystals are recrystallized from a solution of 1000 ml of water and 600 ml of methanol.

CROP I 310 g m.p. 158°–160°C (GLC: 100%)

To the mother liquor are added 300 ml of benzene and 100 ml of ether. The reaction mixture separates into two layers. The organic layer is washed three times with 200 ml portions of water and neutralized with a 10% aqueous solution of sodium bicarbonate. The solvent is removed by distillation from a steam bath under an ejector vacuum. The formed crystals are collected on a Buchner funnel and recrystallized from a solution of 200 ml of benzene and 100 ml of hexane.

CROP II 150 g m.p. 156°–158°C (GLC: 100%)

The combined Crops (I and II) are placed in a 3 liter 3-necked flask with an agitator and 1500 ml of water are added. The product is steam distilled for approximately 1 hour. The steam distillation is necessary to remove traces of contaminants which give an off-odor to the product. From 426 g of the product, 420 g of 2,4-dihydroxy-3-methyl-benzaldehyde having a melting point of 151.5°–152.5°C result after distillation.

A more comprehensive understanding of this invention is obtained by reference to the following examples of perfume compositions:

CHYPRE PERFUME COMPOSITIONS
EXAMPLE I

| Parts by Weight | |
|---|---|
| 2.5 | Oak Moss Extract (Evernia) |
| 2.5 | 2,4-Dihydroxy-3-Methyl Benzaldehyde |
| 22.5 | Oil of Bergamot |
| 7.5 | Oil Vetiver Bourbon |
| 5.0 | Oil of Lavender |
| 7.0 | Oil Sandalwood |
| 1.0 | Oil Patchouli |
| 3.5 | Oil of Cloves |
| 10.0 | Extract of Jasmine |
| 8.0 | Oil of Rose |
| 7.0 | Isobutyl Salicylate |
| 5.0 | Cinnamyl Alcohol |
| 10.0 | Heliotropin |
| 5.0 | Coumarin |
| 2.0 | Oleoresin Tonka Beans |
| 1.5 | Methyl Nonyl Acetaldehyde |
| 100.0 | |

EXAMPLE II

| Parts by Weight | |
|---|---|
| 29.6 | Oil of Sandalwood |
| 15.0 | Phenyl Ethyl Alcohol |
| 5.0 | Oil of Cedarwood |
| 10.0 | Oil Lavender |
| 30.0 | Oil Patchouli |
| 3.0 | Oil Vetiver |
| 2.0 | Extract of Tonka Beans |
| 1.5 | 2,4-Dihydroxy-3-Methyl Benzaldehyde |
| 0.5 | Oil Ylang Ylang |
| 0.3 | Oil Sassafras |
| 0.2 | Dimethyl Hydroquinone |
| 0.1 | Oleoresin Labdanum |
| 1.0 | Castoreum Extract (3% Solution) |
| 0.4 | Vanillin |
| 0.7 | Heliotropin |
| 0.7 | Musk Ambrette |
| 100.0 | |

EXAMPLE III

| Parts by Weight | |
|---|---|
| 17.6 | Coumarin |
| 8.8 | Oil Sandalwood |
| 8.8 | 2,4-Dihydroxy-3-Methyl Benzaldehyde |
| 8.8 | Oil Patchouli |
| 5.9 | Oil Vetiver |
| 35.4 | Linalyl Acetate |
| 14.7 | Phenylethyl Alcohol |
| 100.0 | |

EXAMPLE IV

| Parts by Weight | |
|---|---|
| 32.8 | Linalyl Acetate |
| 8.2 | Coumarin |
| 4.9 | Oleoresin Tonka Beans |
| 6.1 | Oak Moss Extract (Evernia) |
| 4.1 | 2,4-Dihydroxy-3-Methyl Benzaldehyde |
| 4.9 | Oil Patchouli |
| 24.6 | Oil Cedarwood |
| 8.2 | Oil Sandalwood |
| 4.1 | Oil Vetiver Reunion |
| 2.1 | Vanillin |
| 100.0 | |

EXAMPLE V

| Parts by Weight | |
|---|---|
| 2.0 | Oak Moss Extract (Evernia) |
| 15.0 | 2,4-Dihydroxy-3-Methyl Benzaldehyde |
| 13.0 | Oil of Bergamot |
| 7.5 | Oil Vetiver Bourbon |
| 5.0 | Oil of Lavender |
| 7.0 | Oil Sandalwood |
| 1.0 | Oil Patchouli |
| 3.5 | Oil of Cloves |
| 8.0 | Extract of Jasmine |
| 4.0 | Oil of Rose |
| 4.0 | Phenyl Ethyl Alcohol |
| 7.0 | Isobutyl Salicylate |
| 5.0 | Cinnamyl Alcohol |
| 9.5 | Heliotropin |
| 5.0 | Coumarin |
| 2.0 | Oleoresin Tonka Beans |
| 1.5 | Methyl Nonyl Acetaldehyde |
| 100.0 | |

EXAMPLE VI

| Parts by Weight | |
|---|---|
| 3.0 | Oil of Sandalwood |
| 1.0 | Oil of Rose |
| 0.5 | Oil of Cedarwood |
| 1.0 | Oil Lavender |
| 2.0 | Oil Patchouli |
| 0.3 | Oil Vetiver |

-continued

EXAMPLE VI

| Parts by Weight | |
|---|---|
| 0.3 | Extract of Tonka Beans |
| 0.1 | 2,4-Dihydroxy-3-Methyl Benzaldehyde |
| 5.0 | 10% Solution Oil Ylang Ylang in Benzyl Benzoate |
| 3.0 | 10% Solution Oil Sassafras in Benzyl Benzoate |
| 2.0 | 10% Solution Dimethyl Hydroqinone in Benzyl Benzoate |
| 1.0 | 10% Solution Oleoresin Labdanum in Benzyl Benzoate |
| 0.1 | Castoreum Extract (3% Solution) |
| 0.4 | 10% Solution Vanillin in Benzyl Benzoate |
| 0.1 | Heliotropin |
| 0.1 | Musk Ambrette |
| 80.1 | Benzyl Benzoate |
| 100.0 | |

FOUGERE PERFUME COMPOSITIONS

EXAMPLE VII

| Parts by Weight | |
|---|---|
| 11.0 | Oil Lavender |
| 5.0 | Oil Patchouli |
| 8.0 | Coumarin |
| 1.5 | Heliotropin |
| 1.0 | Musk Xylol |
| 0.5 | Musk Ambrette |
| 2.5 | Oil Geranium |
| 20.0 | α-Terpineol |
| 7.5 | Oil Cedarwood |
| 6.0 | Oil Vetiver Reunion |
| 12.5 | Phenylethyl Alcohol |
| 2.5 | para-Methylacetophenone |
| 7.5 | Linalyl Acetate |
| 5.0 | Amyl Salicylate |
| 4.0 | Oak Moss Extract (Evernia) |
| 4.5 | 2,4-Dihydroxy-3-Methyl Benzaldehyde |
| 1.0 | Oleoresin Labdanum |
| 100.0 | |

EXAMPLE VIII

| Parts by Weight | |
|---|---|
| 4.0 | 2,4-Dihydroxy-3-Methyl Benzaldehyde |
| 3.2 | Amyl Salicylate |
| 16.0 | Coumarin |
| 4.0 | Oleoresin Tonka Beans |
| 2.8 | Phenylethyl Alcohol |
| 4.0 | Heliotropin |
| 1.6 | Vanillin |
| 13.6 | Oil Vetiver Java |
| 4.8 | Oil Patchouli |
| 24.0 | Oil Lavender |
| 16.0 | Linalyl Acetate |
| 6.0 | Oil Neroli Bigarade |
| 100.0 | |

2,4-Dihydroxy-3-methyl benzaldehyde can replace partially or completely natural "Oak Moss" extract or any of the synthetic replacements of "Oak Moss". By adding any quantity of the chemical of this invention, the odor quality of natural "Oak Moss" may be achieved with great fidelity but with great reduction in cost.

What is claimed is:

1. A perfume composition comprising at least 1% by weight of 2,4-dihydroxy-3-methyl benzaldehyde and at least 1% by weight of one or more other perfume components.

2. A perfume composition of claim 1 in which the 2,4-dihydroxy-3-methyl benzaldehyde comprises 0.1 to 15% by weight of the perfume composition.

3. A perfume composition of claim 1 in which the 2,4-dihydroxy-3-methyl benzaldehyde comprises 0.5 to 10% by weight of the perfume composition.

4. A perfume composition of claim 1 in which the 2,4-dihydroxy-3-methyl benzaldehyde comprises 1 to 9% by weight of the perfume composition.

* * * * *